US005640888A

United States Patent [19]

Lee

[11] Patent Number: 5,640,888

[45] Date of Patent: Jun. 24, 1997

[54] WOODTURNING SCRAPER BURNISHER AND METHOD OF BURNISHING WOODTURNING SCRAPERS

[76] Inventor: Leonard G. Lee, 517 Westminster Avenue, Ottawa, Ontario, Canada, K2A 2T9

[21] Appl. No.: 443,080

[22] Filed: May 17, 1995

[51] Int. Cl.[6] ..... B21K 5/12

[52] U.S. Cl. ..... 76/89.2; 76/88; 142/56

[58] Field of Search ..... 76/82, 88, 89.2; 142/56

[56] References Cited

U.S. PATENT DOCUMENTS

| | | |
|---|---|---|
| 14,303 | 9/1856 | Kasson . |
| D. 56,250 | 9/1920 | Graf . |
| 102,994 | 5/1870 | Webster . |
| D. 123,490 | 11/1940 | Saffell . |
| D. 149,342 | 4/1948 | Davis . |
| D. 150,955 | 9/1948 | Jacobs . |
| D. 151,324 | 10/1948 | Chaplin et al. . |
| D. 153,706 | 5/1949 | Lathom . |
| 207,339 | 8/1878 | Barwick . |
| D. 229,476 | 12/1973 | Farquharson . |
| D. 249,079 | 8/1978 | Soderman et al. . |
| D. 273,360 | 4/1984 | Hill . |
| 441,758 | 12/1890 | Gowdy . |
| 446,551 | 2/1891 | Chamberlain . |
| 579,726 | 3/1897 | Hillaire . |
| 940,773 | 11/1909 | Ackermann . |
| 1,190,718 | 7/1916 | Brunsell et al. . |
| 1,471,136 | 10/1923 | Borleis . |
| 1,936,990 | 11/1933 | Piermann . |
| 2,069,608 | 2/1937 | Hammond . |
| 2,115,778 | 5/1938 | Krahenbuhl . |
| 2,499,331 | 2/1950 | Robitaille . |
| 4,498,360 | 2/1985 | Milum . |
| 4,934,110 | 6/1990 | Juranitch . |
| 5,099,722 | 3/1992 | Lee . |
| 5,461,943 | 10/1995 | Munkel ..... 76/89.2 |

FOREIGN PATENT DOCUMENTS 293785 3/1928 United Kingdom .

OTHER PUBLICATIONS

The 1995 Garrett Wade Tool Catalog, Sep. 1994–Sep. 1995, items numbered "E", Harris True One–Handed Scraper Burnisher, and F, Improved Comprehensive Harris Scraper Blade Conditioner.

The 1994 Garrett Wade Tool Catalog, Sep. 1993–Sep. 1994, p. 74, item numbered "A," Harris Scraper Blade Conditioner.

Lee Valley Catalog entitled *Fine Woodworking Tools 1992/93*, p. 26, item numbered "E", Veritas® Jointer/Edger.

Lee Valley Catalog entitled *Fine Woodworking Tools 1992/93*, p. 27, item numbered "A", Veritas® Variable Burnisher.

Lee Valley Catalog entitled *Fine Woodworking Tools 1992/93*, p. 27, item number "B", Veritas® Tri–Burnisher.

"Hand Scrapers," *ShopNotes*, Issue 2 (Mar. 1992), pp. 12–15.

George Ott (ULMIA) Catalog (Apr. 1989), pp. 38–39.

Lee Valley Catalog (1984), pp. 131–132.

Lee Valley Tools Catalog (1984), p. 17.

*Primary Examiner*—Steven C. Bishop

*Attorney, Agent, or Firm*—Kilpatrick & Cody, L.L.P.; John S. Pratt

[57] ABSTRACT

A woodturning scraper burnisher and method of burnishing woodturning scrapers. The burnisher is a cast aluminum carrier having a substantially flat face penetrated by three unequally spaced holes into which a conical fulcrum pin and burnishing rod having a protruding truncated conical surface are slip fit. With the carrier fixed in place on a work surface, the underside of a turning scraper is pressed against the face of the carrier while a side of the scraper is positioned against the fulcrum pin and the scraper bevel is forced against and slid relative to the conical surface of the burnishing rod to form a "hook" on the working edge or arris of the scraper.

14 Claims, 2 Drawing Sheets

WOODTURNING SCRAPER BURNISHER AND METHOD OF BURNISHING WOODTURNING SCRAPERS

BACKGROUND OF THE INVENTION

This invention relates to tools and methods for preparing woodturning scrapers.

Traditional woodturning cutting tools fall generally into two categories: (1) scrapers and (2) chisels, gouges, parting tools and the like. Chisels, gouges, parting tools and the like generally have cutting edges formed by tool surfaces that meet at a relatively sharp angle. By contrast, turning scrapers have a working edge or arris or piend formed by tool surfaces that meet at a larger bevel angle. Such tools have traditionally been prepared for use by abrading or grinding the tool bevel in order to form a sharp but somewhat rough edge or burr where the bevel intersects the face of the tool.

This turning scraper working edge can be improved by lapping or honing to remove the burr and by then "burnishing" the bevel adjacent to the edge. In preparing woodworking "scrapers," "burnishing" is not merely polishing but is a process involving sliding the bevel or other tool surface being burnished in contact with a burnishing surface of smooth material that is harder than the metal from which the scraper is made, while the bevel surface and burnishing surface are pressed together with substantial force.

Best turning scraper burnishing results are achieved when the same burnishing angle (the angle between the burnishing surface and the bevel) is maintained throughout the burnishing process and the burnishing angle is as small as possible. This creates the widest possible burnishing contact, which acts to prevent the scraper from suddenly "catching" during the turning process. "Catching" occurs when the burnisher digs into the workpiece or quickly removes an undesirably large quantity of material from the workpiece and is frequently accompanied by oral commentary exploring the extremes of the turner's vocabulary.

However, the smaller the angle between the burnishing surface and the bevel, the greater the force required to deform the steel of the scraper in the process of forming or "turning" a hook on the scraper that is part of the intended result of burnishing the scraper. If the bevel grind angle is reduced, thereby creating a greater angle between the burnishing surface and the bevel and consequently making it easier to "turn" the edge to form a hook, the region of the bevel that is burnished is narrower, and the scraper is substantially more likely to "catch" or gouge the workpiece during use. Moreover, a hook formed with a greater burnishing angle is more fragile than one formed with a smaller burnishing angle and therefore will not last as long.

Some turners burnish turning scrapers to form a "hook" using a conventional burnishing rod, but it is difficult to control the burnishing angle during this process and it is very difficult to apply adequate pressure during burnishing in this manner.

Furthermore, in recent years most turning tools have begun to be manufactured of high speed steel, which is substantially more difficult to deform and therefore successfully burnish than softer steel alloys.

BRIEF DESCRIPTION OF THE INVENTION

The present invention overcomes these and other problems associated with successfully burnishing turning scrapers by positioning a carbide burnishing rod with a truncated cone-shaped burnishing surface in a holder together with a re-positionable pin that provides a pivot point or fulcrum for one side of the scraper, so that burnishing can be accomplished at a desirably small angle relative to the scraper bevel and with the controlled application of very substantial force. Each of the burnishing rod and fulcrum pin are slip fit into one of three or more unevenly spaced holes in the holder to permit relative positioning of the rod and pin to accommodate scrapers of different size and shape.

DETAILED DESCRIPTION OF THE DRAWINGS

Figure 1:
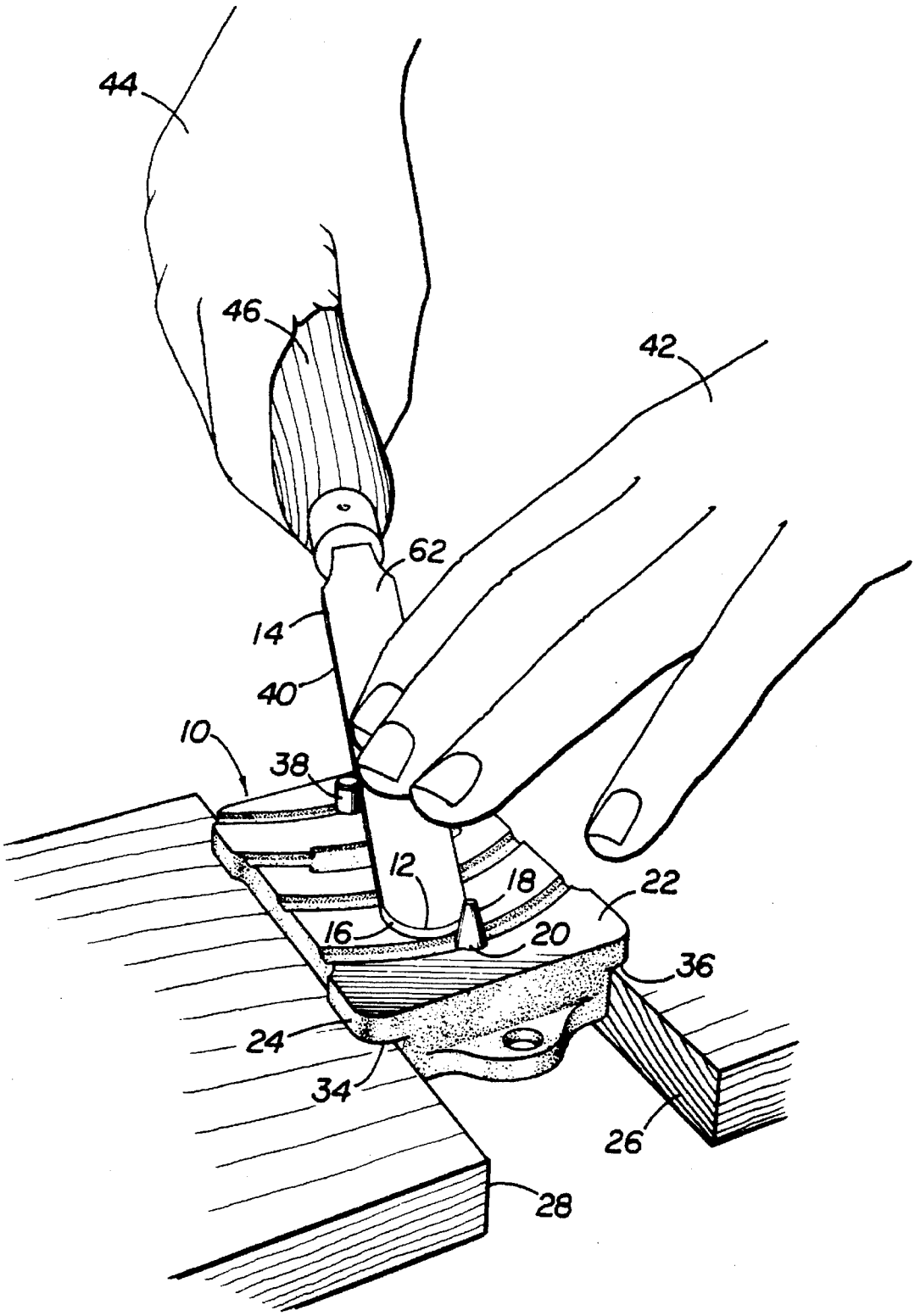
FIG. 1 is a perspective view of the turning scraper burnisher of the present invention shown clamped in place between two boards and in use to burnish a round-nose scraper.

FIG. 1 illustrates use of the woodturning scraper burnisher 10 of the present invention to refine and improve the working edge or arris 12 of a round-nose turning scraper 14 by sliding the bevel 16 adjacent to the arris 12 in firm contact with the truncated conical portion 18 of a burnishing rod 20. Burnishing rod 20 is positioned to protrude from the face 22 of a holder 24 that is firmly fixed in a convenient location as, for instance, by capturing it between clamping blocks 26 and 28 that press against opposed sides 30 and 32 of the holder 24 and against which flanges 34 and 36 of holder 24 rest in order to resist downward displacement of the holder 24 during use. A cylindrical pin 38 positioned normal to the face 22 of holder 24 and spaced apart from the burnishing rod 20 acts as a pivot point or fulcrum against which the side 40 of scraper 14 may be pivoted during burnishing.

Figure 2:
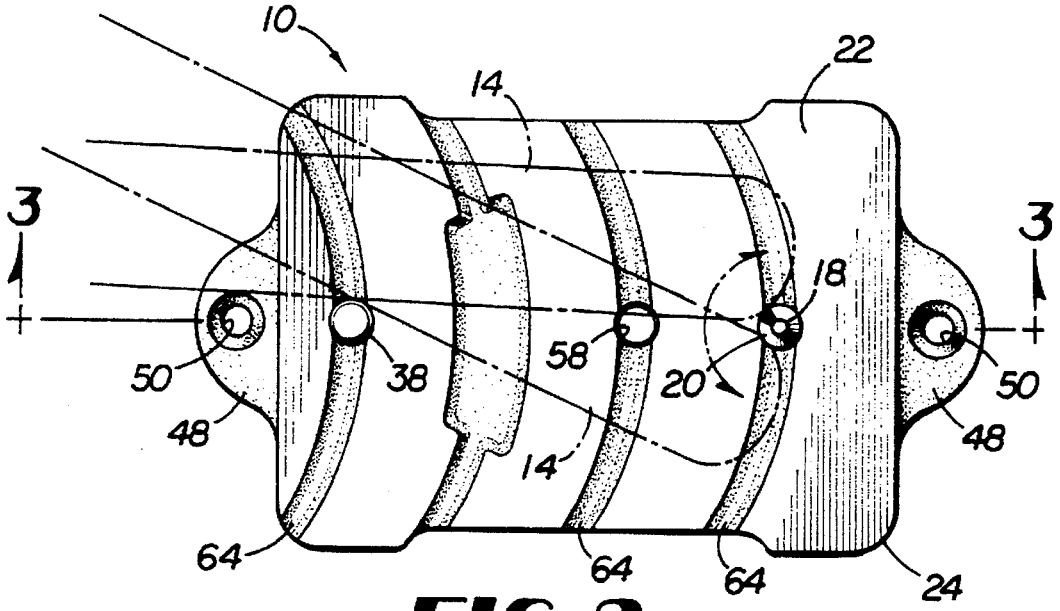
FIG. 2 is a top plan view of the burnishing tool shown in FIG. 1 with two positions of a round-nose scraper during burnishing indicated in broken lines.

As will be appreciated by reference to FIGS. 1 and 2, burnishing is accomplished by placing scraper 14 on the face 22 of holder 24 with a side 40 of scraper 14 against pin 38 while bevel 16 is in contact with burnishing rod 20 and pivoting scraper 14 so that bevel 16 slides against burnishing rod 20 while applying substantial pressure to force bevel 16 against burnishing rod 20. As illustrated in FIG. 1, hands 42 and 44 are used to accomplish this. The operation may be facilitated by pressing one's body in the region of the hips against the handle 46 of scraper 14.

Figure 3:
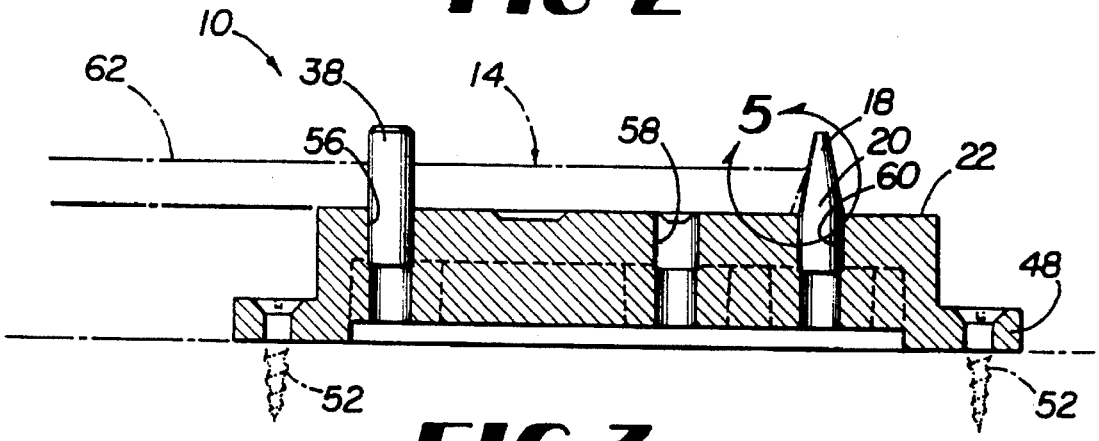
FIG. 3 is a section view of the turning scraper burnisher of the present invention taken along line 3—3 in FIG. 2 shown mounted on a work surface with wood screws.
Figure 4:
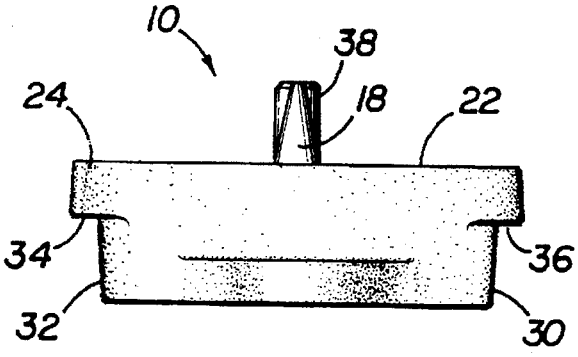
FIG. 4 is an end elevational view of the scraper burnisher of the present invention taken from the end of the tool within which the burnishing rod is located.

As is illustrated in FIGS. 1, 2 and 3, holder 24 has protruding ears 48 on opposite ends of the holder that are penetrated by countersunk holes 50. Ears 48 may, as illustrated in FIG. 3, receive wood screws 52 to fix holder 24 for use on a convenient work surface.

Figure 5:
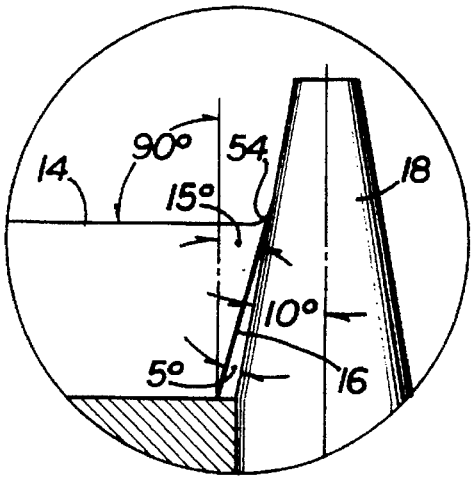
FIG. 5 is an enlarged side elevational view of the burnishing rod of the scraper burnisher of the present invention shown forming a hook on the end of a turning scraper.

As is illustrated in FIG. 5, the truncated conical side 18 of burnishing rod 20 is formed at a shallow angle of, for instance, approximately 10° relative to the longitudinal axis of rod 20. If the bevel of scraper 14 is ground at an angle of approximately 75° relative to the face 62 of scraper 14, the angle between the conical surface 18 of burnishing rod 20 and the bevel 16 of scraper 14 will, therefore, be desirably small, on the order of approximately 5°, which is essentially constant throughout the burnishing operation in view of the conical shape of surface 18 of the rod 20. As may also be seen in FIG. 5, the result of burnishing bevel 16 of scraper 14 is formation of "hook" 54 on scraper 14.

Each of unevenly spaced holes 56, 58 and 60 in holder 24 is sized to receive either pin 38 or burnishing rod 20 with a slip fit, with the result that pin 38 and burnishing rod 20 can be positioned at different relative distances to accommodate different scraper sizes and shapes. Grooves 64 in the face 22 of carrier 24 relieve the face 22 to allow debris to accumulate that might otherwise be trapped between face 22 of carrier 24 and scraper 14.

Preparation of a scraper for use utilizing the woodturning scraper burnisher of the present invention may be accomplished as follows. The bevel 16 of scraper 14 is ground to an appropriate basic bevel angle such as, for instance, approximately 75° relative to the face 62 of scraper 14 (15° relative to a line normal to the scraper face 62). The face or top 62 of the scraper is then lapped or honed adjacent to the bevel 16 using a fine sharpening stone or lapping abrasives to remove any burr. As will be appreciated by reference, in particular, to FIGS. 1 and 2, with the burnisher 10 firmly secured as, for instance, between the jaws of a vise or two blocks 26 and 28 (as illustrated in FIG. 1) or with wood screws (as illustrated in FIG. 3), the scraper 14 is positioned on top surface 22 of the burnisher 10 with the scraper face 62 up. With one hand 42 the scraper 14 is pressed down against the burnisher face 22 while the scraper handle 46 is grasped with the other hand 44 and the bevel 16 is pressed against the burnishing rod 20 while the side 40 of scraper 14 is pressed against the pin 38. Then using pin 38 as a fulcrum and handle 46 as a lever, pressure is exerted to establish firm contact between the bevel 16 and the truncated conical surface 18 of burnishing rod 20 while scraper 16 is pivoted to slide the bevel 16 relative to the burnishing rod 20.

Firm pressure is required to produce a hook 54, especially on scrapers 14 made of high speed steel. Heavy pressure produces a coarse hook useful for roughing and shaping, and light pressure produces a fine hook desirable for finishing and delicate work. The hook producible utilizing the burnisher 10 of the present invention is a smooth, continuous sharp edge that lasts longer before breaking down and cuts more smoothly than a burr formed by grinding only.

As noted above, the material from which a burnishing surface is made should be harder than the material to be burnished. In the case of turning scrapers, the material to be burnished is frequently high speed steel. Accordingly, burnishing rod 20 should be formed of hard steel or, preferably, tungsten carbide, such as C-2 micrograin tungsten carbide.

The material requirements for pin 38 are less demanding, and it can be made of any material strong enough to resist bending or other undesirable deformation, such as steel. Holder 24 may also be manufactured of a variety of suitable materials, among which cast aluminum is particularly desirable.

As will be appreciated by those skilled in the art, the advantages of burnisher 10 of the present invention can be achieved in a wide variety of physical configurations that provide a fulcrum against which a side of a scraper is pivoted while the scraper bevel is pressed against and slid relative to a smooth, hard burnishing surface. Accordingly, the foregoing description of this invention is for purposes of explanation and illustration. It will be apparent to those skilled in the art that modifications and changes may be made to the invention without departing from the scope and spirit of the following claims.

I claim:

1. A burnishing tool for woodturning scrapers that have a top, a bottom, at least one side and a bevel, the tool comprising a fulcrum and a burnishing surface positioned a predetermined distance from the fulcrum so that the side of the woodturning scraper can be pressed against the fulcrum while engaging the bevel of the woodturning scraper with the burnishing surface.

2. The burnishing tool of claim 1, further comprising a generally flat face surface adjacent to both the fulcrum and the burnishing surface and against which the bottom of the scraper may be pressed during use of the burnishing tool.

3. A burnishing tool for woodturning scrapers, comprising a body having at least two holes therein, a pin positionable in one of the holes, and a burnishing rod positionable in the other of the holes.

4. A burnishing tool for woodturning scrapers, comprising:

(a) a carrier having a generally flat face, which face is penetrated by at least two holes, (b) a pin positionable in one of the holes to protrude from the face and (c) a burnishing rod positionable in the other of the holes to protrude from the face.

5. The burnishing tool of claim 4, wherein the holes are round and the burnishing rod has a first cylindrical end to be received in one of the holes in the carrier face and a second conical end to provide a burnishing surface.

6. The burnishing tool of claim 5, wherein the burnishing rod has a longitudinal axis and the conical end of the burnishing rod has a conical surface that slopes at an angle of approximately 10° relative to the longitudinal axis of the rod.

7. The burnishing tool of claim 6, wherein the pin is cylindrical in shape.

8. The burnishing tool of claim 7, wherein the carrier is made of cast aluminum and has arcuate grooves in its face.

9. The burnishing tool of claim 8, wherein the carrier face is penetrated by three holes located unequal distances from each other.

10. The burnishing tool of claim 9, wherein the carrier is generally rectangular in shape having two opposed shorter sides and two opposed longer sides and the carrier has:

(a) one ear protruding from each shorter side and each ear is penetrated by a hole for receiving a fastener and (b) one flange along each longer side.

11. The burnishing tool of claim 10, wherein the burnishing rod is formed of tungsten carbide.

12. A burnishing tool for woodturning scrapers comprising:

(a) a cast aluminum carrier having a generally flat face and generally rectangular shape having two opposed shorter sides and two opposed longer sides and one ear protruding from each shorter side and at least one hole penetrating each ear for receiving a fastener and a flange along each longer side for resting on top of vise jaws or other holding members when the carrier is clamped between the jaws or holding members, which carrier face is penetrated by three unevenly spaced round holes and by arcuate relief grooves;

(b) a cylindrical fulcrum pin positionable to protrude from any one of the holes in the carrier face; and (c) a tungsten carbide burnishing rod having a longitudinal axis and two ends, one of which ends is cylindrical for insertion into another of the holes in the carrier face so that the other end of the burnishing rod protrudes from the carrier face and said other end of the rod is a truncated cone that slopes at an angle of approximately 10° relative to the longitudinal axis.

13. A method of burnishing a woodturning scraper having a working bevel and at least one side comprising the steps of:

(a) positioning the scraper side against a fulcrum while positioning the scraper bevel against a burnishing surface that is fixed in position relative to the fulcrum;

(b) applying substantial pressure forcing the bevel against the burnishing surface; and (c) manipulating the scraper to slide the bevel relative to the burnishing surface while maintaining contact between the scraper side and the fulcrum.

14. The woodturning scraper burnishing method of claim 13 further comprising the steps of preparing the bevel for burnishing by:

(i) grinding the bevel and then (ii) lapping or honing the scraper to remove any wire edge resulting from the grinding.

* * * * *